US006953260B1

(12) United States Patent
Allen

(10) Patent No.: US 6,953,260 B1
(45) Date of Patent: Oct. 11, 2005

(54) CONVERTIBLE FLASHLIGHT-HEADLAMP

(76) Inventor: David M. Allen, 93890 Pope Rd., Blachly, OR (US) 97412

( * ) Notice: Subject to any disclaimer, the term of this patent is extended or adjusted under 35 U.S.C. 154(b) by 0 days.

(21) Appl. No.: 10/245,607

(22) Filed: Sep. 16, 2002

Related U.S. Application Data

(60) Provisional application No. 60/331,941, filed on Nov. 16, 2001.

(51) Int. Cl.[7] ..... F21L 4/00

(52) U.S. Cl. ..... 362/194; 362/199; 362/419; 362/427; 429/96

(58) Field of Search ..... 362/194, 195, 362/198, 199, 418, 419, 426, 427, 188; 429/96, 97, 98, 99, 123

(56) References Cited

U.S. PATENT DOCUMENTS

| | | | | |
|---|---|---|---|---|
| 2,164,898 A | * | 7/1939 | Brown | 362/105 |
| 3,330,949 A | | 7/1967 | Bush | 240/6.45 |
| 3,852,587 A | * | 12/1974 | Koehler | 362/106 |
| 3,870,843 A | * | 3/1975 | Witte | 200/302.2 |
| 4,242,724 A | | 12/1980 | Stone | 362/158 |
| 4,408,261 A | | 10/1983 | Polakoff | 362/104 |
| 4,530,034 A | * | 7/1985 | Kawarada | 362/9 |
| 4,607,207 A | * | 8/1986 | Bruneau | 429/99 |
| 4,774,643 A | | 9/1988 | McGinnis et al. | 362/189 |
| 4,837,559 A | | 6/1989 | Green, Sr. | 340/573 |
| D321,785 S | | 11/1991 | Garrity | D3/63 |
| 5,070,437 A | | 12/1991 | Roberts, Sr. | 362/158 |
| 5,134,558 A | | 7/1992 | Williams et al. | 362/263 |
| 5,143,439 A | | 9/1992 | Lewis et al. | 362/103 |
| 5,201,578 A | | 4/1993 | Westmoland | 362/104 |
| 5,226,708 A | * | 7/1993 | Katahira et al. | 362/9 |
| 5,228,770 A | * | 7/1993 | Brunson | 362/194 |
| 5,319,531 A | | 6/1994 | Kutuyak | 362/184 |
| 5,386,351 A | | 1/1995 | Tabor | 362/201 |
| 5,486,432 A | * | 1/1996 | Sharrah et al. | 429/99 |
| D367,087 S | | 2/1996 | Mathews | D21/109 |
| D375,372 S | | 11/1996 | Allen | D26/37 |
| D380,566 S | | 7/1997 | Chen | D26/37 |
| 5,927,842 A | | 7/1999 | Preisler | 362/103 |
| 5,927,846 A | | 7/1999 | Sinclair | 362/189 |
| 5,980,062 A | | 11/1999 | Bell | 362/184 |
| 6,015,217 A | | 1/2000 | Colangelo et al. | 362/103 |
| 6,016,038 A | | 1/2000 | Mueller et al. | 315/291 |
| 6,022,127 A | | 2/2000 | Krietzman | 362/259 |
| 6,070,990 A | | 6/2000 | Dalton et al. | 362/201 |
| 6,095,661 A | | 8/2000 | Lebens et al. | 362/184 |
| 6,099,142 A | * | 8/2000 | Liu | 362/191 |
| 6,135,605 A | | 10/2000 | Hsu et al. | 362/102 |
| 6,249,089 B1 | | 6/2001 | Bruwer | 315/200 A |
| 6,305,818 B1 | | 10/2001 | Lebens et al. | 362/184 |

* cited by examiner

*Primary Examiner*—Sandra O'Shea
*Assistant Examiner*—John Anthony Ward
(74) *Attorney, Agent, or Firm*—Black Lowe & Graham PLLC

(57) ABSTRACT

The instant invention provides a convertible lighting device featuring a battery housing and a detachable lamp assembly. The lighting device can be operated in flashlight and headlamp modes.

20 Claims, 5 Drawing Sheets

FIG. 9
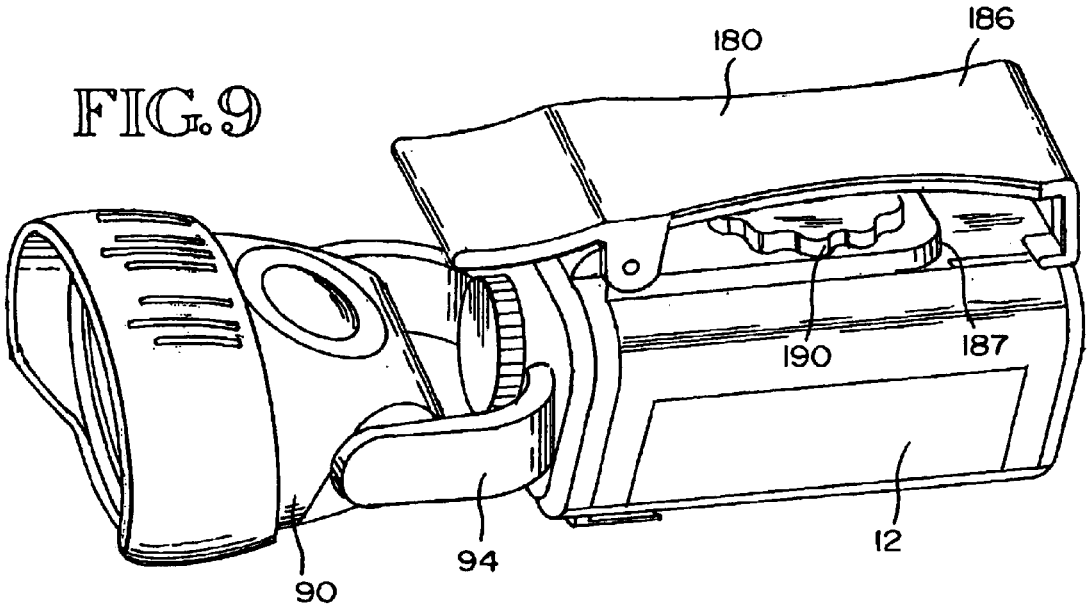
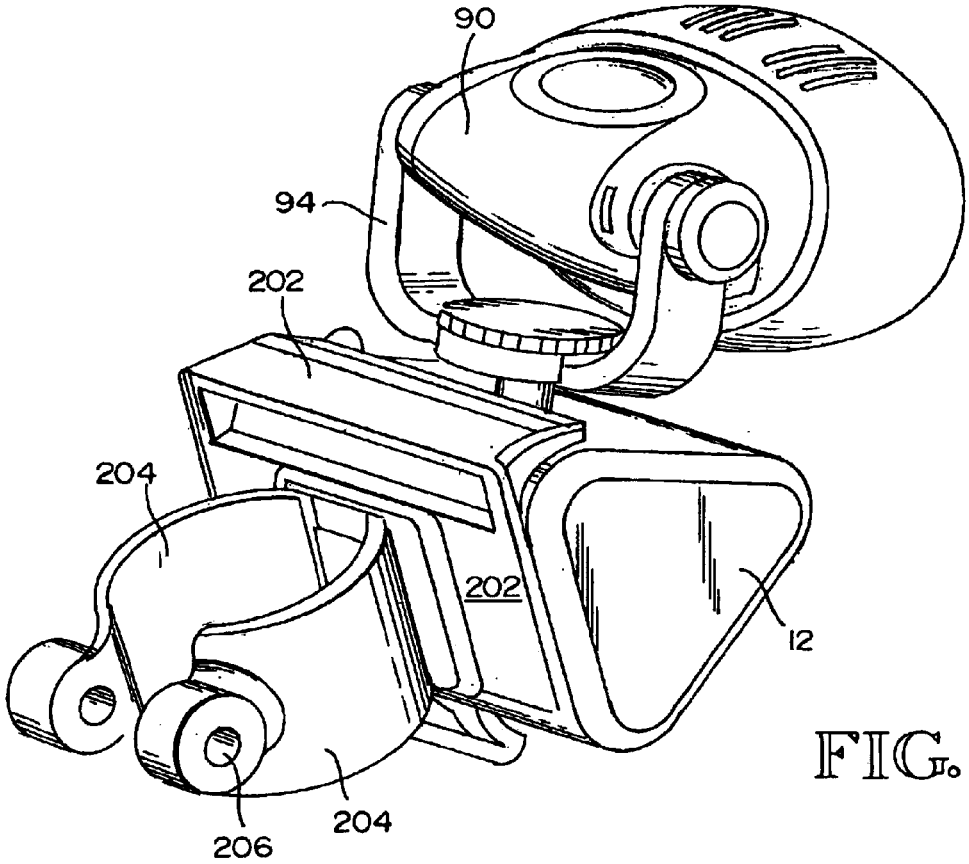
FIG. 10

CONVERTIBLE FLASHLIGHT-HEADLAMP

CROSS REFERENCE TO RELATED APPLICATION

This application claims priority from abandoned U.S. Provisional Patent Application Ser. No. 60/331,941 entitled "Convertible Flashlight-Headlamp" filed on Nov. 16, 2001 by David M. Allen.

BACKGROUND OF THE INVENTION

Hand-held (portable) lighting devices, such as portable lanterns and flashlights, have long been in use for a variety of purposes and come in diffrerent designs. The most common portable lighting device is tile conventional flashlight. The typical flashlight design incorporates a cylindrical battery housing adapted to hold one or more standard dry cell batteries. Coupled to one end of the battery housing is a lamp assembly. The lamp assembly provides a protective covering for a lamp. Tile lamp assembly generally includes a conical, mirrored reflector to focus light from the lamp in a narrow output beam, as well as a clear lamp cover to shield the lamp from impact and moisture. The lamp assembly is typically threadably connected to the battery housing, so that one electrical contact or lead of the lamp is held in electrical connection with one terminal of the battery. A switch, most often located on the battery housing, regulates operation of the lamp by electrically connecting or disconnecting a second battery terminal to a second contact or lead of the lamp. Alternative switch designs place the lamp in electrical connection with a lead extending from the second battery terminal, for example by positioning the lamp assembly closer to the battery housing to advance the lamp closer to the lead.

Portable lighting devices have also been designed to be used as headlamps. One headlamp is designed to be attached to the side of the head. Such headlamps generally have a strap that is wrapped around the head of the wearer. The headlamp body, typically a flashlight, is attached to the strap so that the light projects forward. Another headlamp design has a lamp assembly and battery housing that is positioned on the forehead of the wearer. Alternatively, the battery housing can be attached to the belt of the wearer and electrically connected to lamp assembly by electrical wires. Other headlamps are designed to be clipped to a hat or strapped to the head of the user.

Portable lighting devices such as headlamps and flashlights are designed for different uses, however. When these portable lighting devices are used in other modes, they are generally awkward to use. For example, a flashlight mounted to the side of the head as a headlamp can be awkward to use because the weight is non-uniformly distributed to one side of the wearer's head. Similarly, headlamp designs, such as those designed to be attached to a hat or to the forehead of the user, are typically not ergonomically suitable for handheld use. In applications where both flashlights and headlamps may be required, the user can be required to provide both such devices. Thus, there is a need for a portable lighting device that is convertible between a flashlight and headlamp.

SUMMARY OF THE INVENTION

The present invention provides a convertible and portable lighting device featuring a battery housing and a detachable lamp assembly. The battery housing has a plurality of mounting ports for operation of the device in headlamp and flashlight modes. In an embodiment, the battery housing has at least one side portion, a bottom portion and a top portion defining a battery compartment. In one embodiment, the battery housing has three side portions, a top portion and a bottom portion. The top or bottom portion can optionally be hingedly connected to the battery housing.

One or more batteries can be inserted into the battery housing. For example, in one embodiment, the battery housing can hold three batteries. The battery housing typically includes at least two mounting ports. Each mounting port includes one or more electrical contacts that are electrically connected to the battery or batteries. In one embodiment, a first mounting port is located at a top portion, and a second mounting port is located at a side portion.

The lighting device can further includes a removable lamp assembly that includes a collar. Arms are connected to the collar, and a lamp housing can be pivotally mounted between the arms. Electrical contacts in the collar are electrically connected to one or more lamps in the lamp assembly. The lamps can optionally be light emitting diodes. A reflector can optionally be included in the lamp assembly.

In an embodiment, the collar is connected to a mounting port by a connection mechanism, such as, for example, a screw that can be connected to a threaded receptacle of a mounting port. The mounting ports and lamp assemblies can optionally include orientation receptacles and tabs or protrusion.

The battery housing or lamp assembly can optionally include a switching means electrically connected between the battery or batteries and at least one lamp to modulate power delivery. The switching means can optionally include a flexible ceiling, such as, for example, an ovate or circular diaphragm integrally formed and centrally disposed in said lamp housing. In an embodiment, the switching means can include a multi-function control device having selectable control means to connect and disconnect power to said the lamp(s) and to select between a plurality of operational modes. The selectable control means can be, for example, a manual switch to control an on-off mode and, optionally, another operational mode. The second operational mode can be, for example, a flashing mode.

The selectable control means can also optionally include a microprocessor to control at least one operational mode of the portable lighting device. For example, the operational mode can be a flashing mode, a brightening mode, a dimming mode, a battery protection mode, and/or an auto-off mode. The microprocessor can optionally control a cycle rate or intensity of one or more lamps within a selected operational mode. In another embodiment, the microprocessor controls a brightening or dimming mode having at least two selectable lamp intensity options, a flashing mode having at least two selectable lamp flashing rate options, a battery protection mode and/or an auto-off mode functional to automatically terminate power to lamp(s) after a predetermined time of operation.

BRIEF DESCRIPTION OF THE DRAWINGS

FIG. 9 depicts a perspective view of an embodiment of the convertible light device in a flashlight mode and including a belt clip.

FIG. 10 depicts a perspective view of an embodiment of the convertible light device in a headlamp mode and including a bicycle clip.

DESCRIPTION OF THE INVENTION

Figure 1:
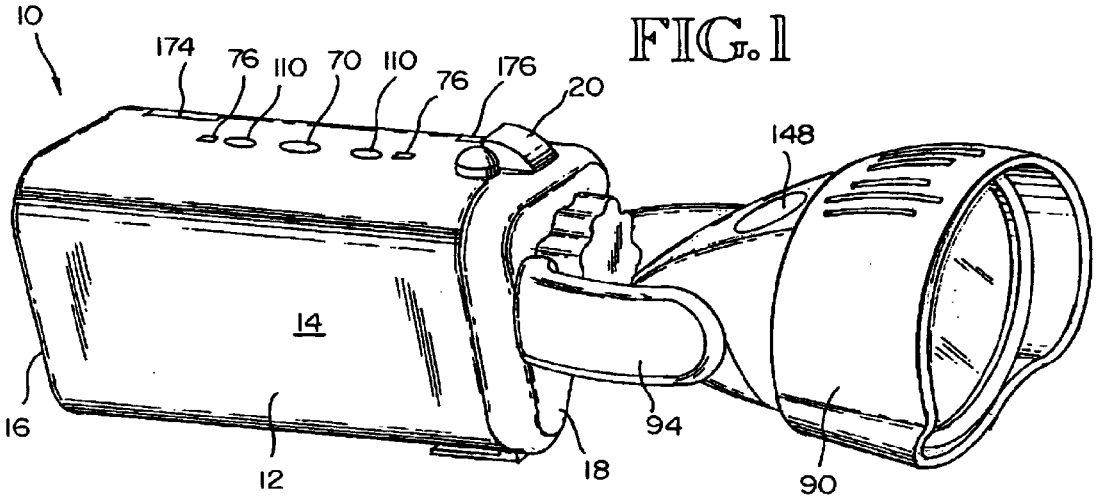
FIG. 1 is a perspective view of an embodiment of the convertible light device incorporating the concepts of the present invention.

The present invention provides a convertible and portable lighting device featuring a battery housing and a detachable lamp assembly. The lighting device can be operated in flashlight and headlamp modes. The battery housing has at least two mounting ports. A first mounting port is typically located on the top portion of the battery compartment. When the lamp assembly is connected to the first mounting port, the lighting device can be operated in a flashlight mode. A second mounting port is typically located on one of the side portions of the battery housing. When the lamp assembly is connected to the second mounting port, the lighting device can be operated in a headlamp mode.

The lamp assembly features a lamp housing connected by a pair of arms to a mounting flange. The lamp housing is pivotable between the arms, so that the lamp housing can be rotated fore and aft. The lamp housing is sized and dimensioned to receive one or more lamps, such as light emitting diodes. (As used herein, the term "lamp" can refer to one or more lamps, unless otherwise indicated by context.) Two electrical contacts are typically associated with the mounting flange. The electrical contacts are electrically connected to the lamp.

The electrical contacts in the battery housing are electrically connected to one or more batteries. (As used herein, the term "battery" can refer to one or more lamps, unless otherwise indicated by context.) When the lamp assembly is connected to the first mounting port, the lamp assembly electrical contacts are electrically connected to the first mounting port electrical contacts to provide electrical power to the lamp. Similarly, when the lamp assembly is connected to the second mounting port, the lamp assembly electrical contacts are electrically connected to the second mounting port electrical contacts to provide electrical power to the lamp.

In a specific embodiment, the battery housing is defined by a plurality of side portions (or sidewalls), a bottom portion and a top portion. The battery compartment is sized and dimensioned to receive at least one battery. The battery housing typically has internal seating surfaces to seat one or more batteries. One portion of the battery housing, typically the top or bottom portion, is removable (e.g., hingedly) to provide access to the battery compartment.

Enclosed within or integrated with the battery housing are electrical connector elements (e.g., posts, wires, leads, and the like) that electrically connect the lamp in the lamp assembly to battery terminals of opposite polarity to complete an electrical circuit supplying power from one or more batteries to the lamp. The battery housing is typically formed of an impact-resistant material.

In more detailed aspects, the battery housing further includes electrical connector elements that electrically interconnect the battery terminals to the electrical contacts in the first and second mounting ports. The electrical connector elements are typically directly connected between the battery terminals and the electrical contacts in the ports.

The lamp housing and/or battery housing also have enclosed or integrated therein a switch mechanism electrically interconnected between the battery and lamp to modulate power delivery between the battery and the lamp. In certain aspects, the switch that modulates power delivery from the battery to the lamp is manually depressible, such as in a downward direction. This manual depression causes actuates the switch. When the lamp assembly is connected to a mounting port, actuation of the switch completes power transfer to the lamp. A second or subsequent depression of the switch turns the lamp off. In another embodiment, the switch mechanism optionally incorporates a thin-walled, flexible member that is an ovate or circular diaphragm integrally formed and disposed within the lamp housing. The flexible member protects the switch mechanism from moisture and dust.

In an alternative embodiment, the portable lighting device includes a multi-function control device as part of the switch mechanism, or as a separate component. The multi-function control device has a selectable control mechanism to connect and disconnect power from the battery to the lamp and to select between a plurality of operational modes of the lamp. In certain embodiments, the selectable control mechanism includes a manual switch to control an on-off mode and an analog control circuit to control a second operational mode. For example, the second operational mode can be a brightening or dimming mode, and the analog control circuit can be a conventional dimmer, rheostat or similar circuitry electrically connected to the lamp.

In another embodiment, the portable lighting device includes a multi-function control device as above, wherein the selectable control mechanism includes a microprocessor control unit. The microprocessor control unit is functional to control one or more operational modes of the lamp. For example, selectable lamp operational modes controlled by the microprocessor control unit may include one or more of the following: an on-off switched mode; a flashing mode; a brightening mode; a dimming mode; and/or an auto-off mode. In more detailed aspects, the microprocessor control unit can further control a cycle rate or intensity of the lamp within one or more selected operational mode(s). In exemplary embodiments, the microprocessor controls a brightening or dimming mode having at least two, typically three, selectable lamp intensity options, a flashing mode having at least two selectable lamp flashing rate options, and an auto-off mode functional to automatically terminate power to the lamp after a predetermined time of operation.

DESCRIPTION OF THE SPECIFIC EMBODIMENTS

Referring to FIG. 1, the present invention is directed to a portable lighting device 10 having a battery housing 12 and a lamp assembly 90. The lamp assembly 90 can be connected to the battery housing 12 in flashlight and headlamp modes.

The battery housing 12 encloses a battery compartment and has two or more mounting ports for attachment of the lamp assembly. The battery housing typically has a plurality of side portions (e.g., sidewalls) 14, a bottom portion 16, and a top portion 18. The size, shape and number of side portions 14, bottom portions 16 and top portions 18 can be chosen according to the desired size and shape of battery housing 12, and/or the number of batteries to be contained by the battery housing 12. For example, as shown in FIG. 1, a generally triangular battery housing 12 has three side portions 14. The edges of the side portions 14 optionally can be rounded corners. The bottom 16 and top 18 portions are generally triangular in shape. In other embodiments, a rectangular battery housing 12 can have four side portions and generally square or rectangular bottom 16 and top 18 portions. A cylindrical battery housing 12 can have one side portion 14, and generally circular bottom 16 and top 18 portions. Other configurations are possible and within the scope of the invention.

The battery housing 12 is typically formed of an impact-resistant material, such as a molded, resilient polymer, and can be constructed from multiple components that are glued, welded, interlocked or otherwise integrated to form the battery housing 12. For example, the battery housing 12 can be constructed from separate first, second and third side portions 14, a bottom portion 16, and a top portion 18. Alternatively, the battery housing 12 can be a unitary structure which typically includes a molded battery housing 12 having side portions 14 and a bottom portion 16, and/or a top portion 18. In such an embodiment, the top portion 18 or bottom portion 16, respectively, can be removable, as further discussed below.

In certain detailed aspects, an exterior surface of the battery housing 12 or lamp assembly 90 can be molded or worked to provide a surface for stamping, engraving, imprinting, or application of a label, having an ornamental or informational design, logo, or trademark to facilitate use and/or sale of the portable lighting device 10. In one embodiment, the battery housing 12 is provided with a smooth exterior surface for this purpose. Any other external surface of the housing of sufficient size can be rendered during or after manufacture of the housing to provide a smooth surface for decoration. Alternatively, the surface can be decorated or imprinted during manufacture of the flashlight.

Figure 2:
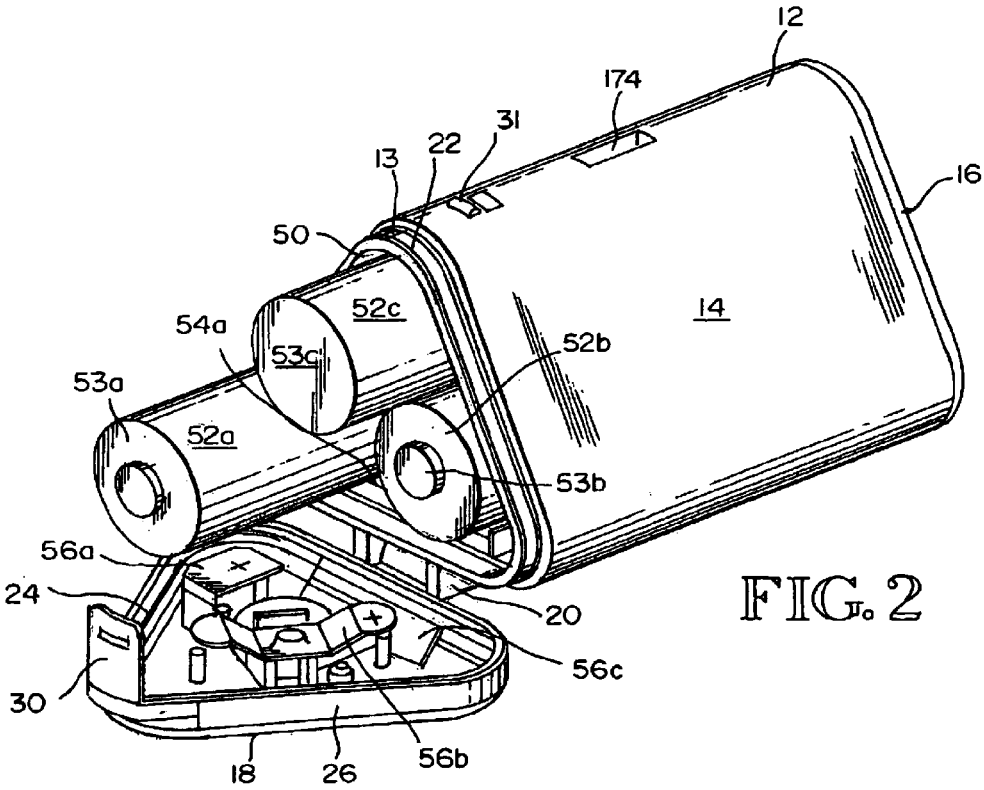
FIG. 2 is a perspective view of an embodiment of a battery housing and battery compartment of a portable illumination device.

Referring to FIG. 2, the battery housing 12 forms a battery compartment 50. The battery compartment 50 can be formed by the side walls 14, the bottom portion 16, and the top portion 18. For example, the battery compartment 50 can be formed by three side portions 14 and bottom portion 16. The battery compartment can be accessed by an opening formed in the battery housing 12. For example, the top portion 18 can be removably connected to a side portion 14, such as by a hinge 20. The top portion 18 can be opened to provide access to the battery compartment 50 and to insert or remove batteries from the battery compartment 50. The top portion 18 can also be removable, without connection to a side portion (e.g., without a hinge). Instead, the top portion 18 is separated from the side portions 14 for access to the battery compartment 50.

In certain embodiments, the top portion 18 typically sealingly engages the battery housing 12. For example, the top portion can sealingly engage a rim 13 to provide moisture resistance and/or dust resistance. A rim 13 can have, for example, a lip or ridge 22 that engages a groove 24 of side wall 26 of the top portion 18. The lip 22 and groove 24 form a seal when the top portion is closed. The lip 22 can be located at any suitable location of the rim 13. The lip 22 and groove 24 engagement can also serve to hold the top portion 18 in the closed position. Other mechanisms for sealing the engagement of a top portion 18 and side portion 14 are possible and within the scope of the invention. The top portion also can be held in a closed position, for example, using a protrusion 30 that engages a tab 31 on the body of battery housing 12. An aperture in the protrusion engages the tab 31 when the top portion is in the closed position. Alternatively, the closure mechanism can be, for example, a snap engagement formed by a protrusion and receptacle; the protrusion is inserted into the receptacle when the top portion is in a closed position. Other closure mechanisms are possible and within the scope of the invention.

In another embodiment, the bottom portion 16 of battery housing 12 is removable for access to the battery compartment 50. The battery compartment 50 can be formed by the side walls 14 and the top portion 18. The bottom portion 16 can be removably connected to one of the side portions 14, such as by a hinge 20. The bottom portion 16 also can be removable from the side portions (e.g., without a hinge). Instead, the bottom portion 16 can be separated from the side portions 14 for access to the battery compartment 50. Any of the sealing and/or closure mechanisms described herein, or known to the skilled artisan, can be used.

The battery compartment 50 is sized and dimensioned to receive at least one battery 52. For example, referring to FIG. 2, the battery compartment 50 contains three batteries 52*a*, 52*b* and 52*c*. In other embodiments, the battery compartment 50 can be sized and dimensioned to receive one, two, four, or more batteries. Such batteries can be, for example, standard AAA, AA, C, or D batteries, 9 volt batteries, discoid lithium batteries, and the like. The batteries can be, for example, carbon zinc, alkaline, nickel cadmium, nickel metal hydride, lithium, as well as other types of batteries.

The batteries 52 are typically seated on internal seating surfaces in the battery compartment. For example, referring to FIG. 2, the seating surfaces can comprise the interior surfaces of side portions 14 and bottom portion 16. The battery seating surfaces also can be molded to the shape of a battery 52. Such a seating surface can partially or completely surround a battery 52. Each battery 52 can be held in place in the battery compartment 50 by a battery retaining mechanism, which maintains a compressive force on the battery. For example, referring to FIG. 2, the battery retaining mechanism can be battery spring clips 54*a* and 54*b*, which apply compressive force to the batteries 52. In other embodiments, the batteries 52 can be held in a place by a battery holder, such as that disclosed in U.S. Pat. No. 5,871,272 (the disclosure of which is incorporated by reference herein). The battery holder typically receives one or more batteries in individual slots or cells.

The battery housing 12 typically has two mounting ports, referred to as the first and second mounting ports, although greater numbers of mounting ports are possible. Each mounting port typically has a connection mechanism and electrical contacts. The connection mechanism provides detachable connection between the battery housing 12 and the lamp assembly 90. The electrical contacts provide electrical connection between the battery housing 12 and the lamp assembly 90.

Figure 3:
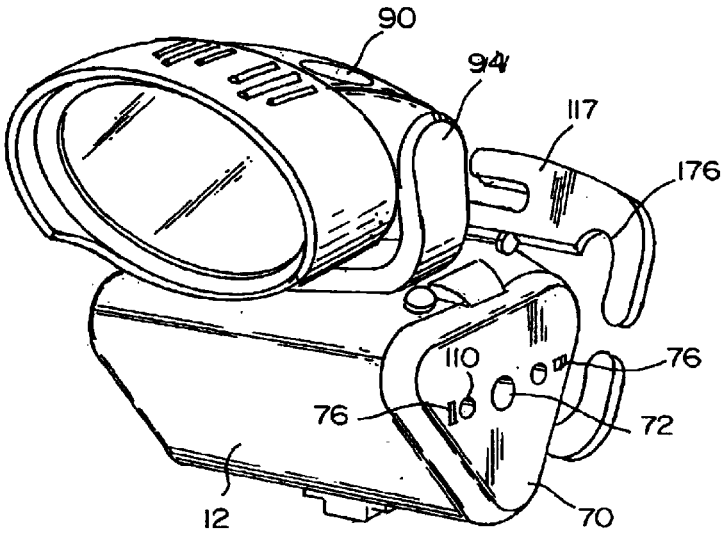
FIG. 3 is a perspective view of an embodiment of a convertible light device in a headlamp configuration and having attached an optional headlamp clip.

Referring to FIG. 3, an embodiment a battery housing 12 with a first mounting port 70 is depicted. The first mounting port 70 includes a connection mechanism, such as, for example, a threaded receptacle 72 for receiving a screw or other threaded shaft. One or more orientation receptacles or tabs 76 optionally can be included for proper orientation of the lamp assembly 90 on the battery housing 12.

Figure 4:
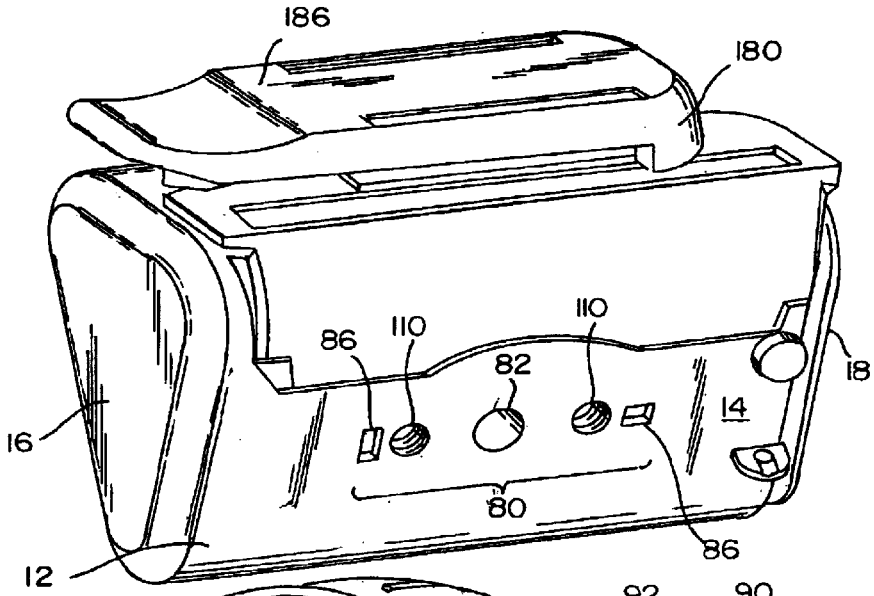
FIG. 4 is a perspective illustration of the battery housing having attached an optional belt clip attached.

Referring to FIG. 4, an embodiment of a battery housing 12 having a second mounting port 80 is depicted. The second mounting port 80 includes a connection mechanism, such a threaded receptacle 82 for receiving a screw or other threaded shalt. Orientation receptacles or tabs 86 optionally can be included for proper orientation of the lamp assembly 90 on the battery housing 12.

Other configurations of a mounting port are possible. For example, a mounting port can include a side wall and a rim that forms an aperture or cavity. The mounting port can also optionally have notches in the rim to assist in attachment of a lamp assembly.

An electrical circuit is provided between the batteries 52 in the battery housing 12 and electrical contacts in the mounting ports. To form the circuit, electrical connector elements (generally designated by reference numeral 56) can be used. Such electrical connector elements include, for example, posts, clips, wires, leads, and other electrically conductive materials. For example, referring to FIG. 2, when top portion 18 is closed, a first electrical connector element 56*a* connects to a battery terminal 53*a*. A second electrical connector element 56*b* electrically interconnects battery terminals 53*b* and 53*c*. A spring clip 54*b* also can be an electrical connector element 56 that contacts a distal end of battery 52*b*. When top portion 18 is closed, an electrical connector element 56*a* contacts spring clip 54*a*, and electrical connector element 56*c* contacts the spring clip 54*b*. Electrical connector element 56*a* exerts a compressive force against battery terminal 53*a*, and electrical connector element 56*b* exerts a compressive force against battery terminals 53*b* and 53*c*. These compressive forces provide consistent contact between the battery terminals 53*a*–53*c* and the electrical connector elements 56*a* and 56*b*.

Referring to FIGS. 2 and 3, electrical contacts 110 in the first mounting port 70 are electrically connected to electrical connector elements 56*a* and 56*c*. Referring to FIG. 3, in one embodiment, two electrical contacts 110 are included in the first mounting port 70. An electrical contact 110 is electrically connected to electrical connector element 56*a*, and the other electrical contact 110 is electrically connected to electrical connector element 56*c*. Referring to FIGS. 2 and 4, electrical contacts 110 are also included in the second mounting port 80. One electrical contacts 110 is connected with the battery via electrical connector elements spring clip 54*a* and electrical connector element 56*a*, and the other electrical contact 110 is electrically connected with the battery via electrical connector element 56*c* and spring clip 54*b*.

In other embodiments, other configurations of the electric circuit of the battery housing are possible and within the scope of the invention. For example, the electrical connector elements 56 can be continuous leads or wires extending between the battery terminals 53 and electrical contacts 110. The electrical connector elements 56 can also be external to the battery housing 12, or they can pass through portions of the battery housing 12. Alternatively, the electrical connector elements 56 can be embedded in a side portion 14, or in other structure of the battery housing 12.

The electrical contacts 110 can be flush mounted with the battery housing 12, can be recessed below a surface of battery housing 12, or can project from a surface of battery housing 12. The contact between the electrical contacts 110 and the battery housing 12 is typically sealed to prevent entry of moisture and/or dust.

Figure 5:
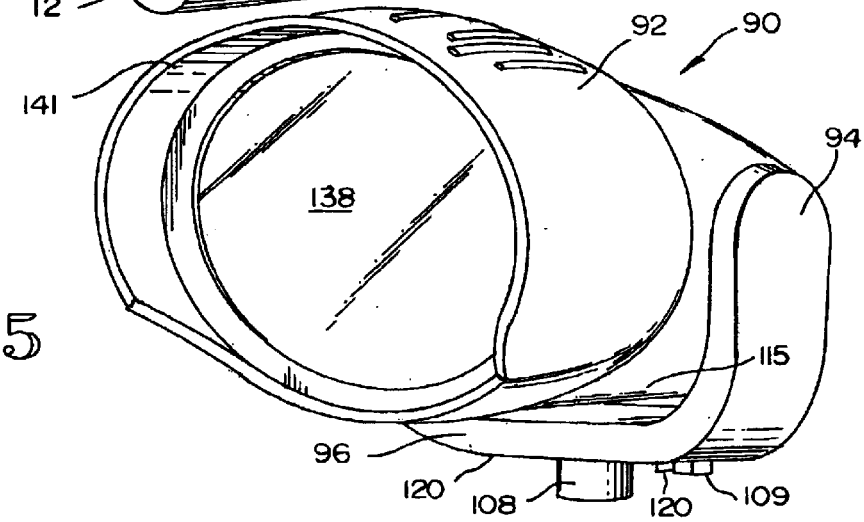
FIG. 5 is perspective view of an embodiment of a lamp assembly.

The portable lighting device further includes a detachable lamp assembly 90. Referring to FIG. 5, the lamp assembly 90 includes lamp housing 92, arms 94 and collar 96. The arms 94 are connected to the collar 96. The lamp housing 92 is pivotally mounted to the arms 94, such that the lamp housing 92 can be rotated fore and aft. In a typical embodiment, the lamp housing 92 can be rotated over a range of about 180–190 degrees fore and aft, although greater and lesser ranges of motion are possible.

Any suitable pivotal mounting can be used to connect the lamp housing 92 to the arms 94. For example, the pivotal connection can include a shaft, tab or pin on an arm 94 that is inserted into a receptacle on the lamp housing. The pivotal connection can include, for example, a pivot ring and pin, a ball bearing race, and ball bearing, and the like. The pivot ring can be indexed, having a series of holes or dimples to receive a ball bearing. The lamp housing 92 can be incrementally rotated about the pivotal mounting. Alternatively, the pivot ring can have a single slot that allows continuous positioning of the lamp housing 92.

The lamp assembly 90 can be connected to a Mounting port to operate the portable lighting device 10 in the flashlight or headlamp configurations. In certain embodiments, a portable lighting device 10 can be also be used table top light, a bicycle light, and the like, when in a flashlight and/or headlamp mode.

Referring to FIG. 5, the collar 96 of the lamp assembly 90 can include a connection mechanism, such as a threaded screw 108, orientation receptacles or tabs 109 and electrical contacts 120. The threaded screw 108 can project through the collar 96 and connect to a thumbscrew 155, which aids in attaching lightening and loosening the screw 108. Referring to FIGS. 1 and 5, the orientation tabs or receptacles 109 are typically differently shaped; the size and shape of the orientation tabs or receptacles typically correspond to the shapes of orientation receptacles or tabs 76 and 86.

Figure 8:
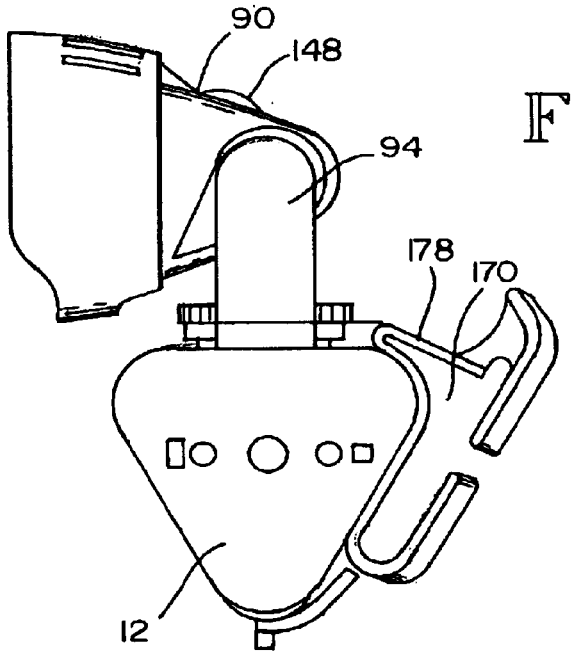
FIG. 8 depicts a side perspective view of an embodiment of the convertible light device in a headlamp mode and including a headlamp clip.

When the portable lighting device 10 is operated in a flashlight configuration, the collar 96 is connected to the first mounting port 70. Referring to FIGS. 1 and 5, the screw 108 is threadedly connected to the threaded receptacle 72. The orientation tabs or receptacles 109 are aligned with the corresponding orientation receptacles or tabs 76. Referring to FIGS. 3 and 8, when the portable lighting device 10 is operated in a headlamp configuration, the collar 96 is connected to the second mounting port 80. The screw 108 is threadably connected to the threaded receptacle 82. The orientation tabs or receptacles 109 are aligned with the corresponding orientation receptacles or tabs 86. In either configuration, when the lamp assembly 90 is connected to the battery housing, the electrical contacts 120 of the lamp assembly 90 are in electrical contact with the electrical contacts 110 of the battery housing 12.

In other embodiments, the collar 96 can include a mounting flange. The mounting flange can descend from the collar 96. The mounting flange typically has one or more protrusions. The outside diameter of mounting flange can be smaller than the inside perimeter defined by a rim of a mounting port so that the mounting flange can be inserted into the cavity. The mounting flange can optionally have one or more protrusions that are smaller than a notch in a rim of the mounting port, so that the protrusions can be inserted therethrough.

Figure 6:
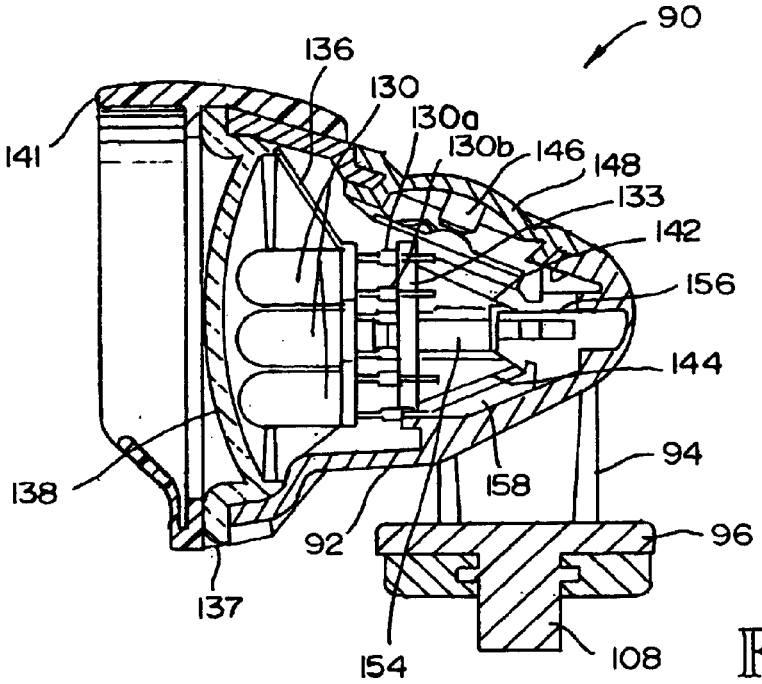
FIG. 6 is a cross-sectional view of an embodiment of a lamp assembly.

The lamp housing 92 encloses at least one lamp 130. Referring to FIG. 6, an example of the internal structure of the lamp housing 92 is shown. The lamp housing 92 can have one or more lamps 130. The lamps can be directly connected to a circuit board 133. Alternatively, the lamps can be connected to a lamp mount, such as a lamp socket. The lamp socket can be connected to the circuit board 133. The lamp 130 can be electrically connected directly to the lamp mount or to the circuit board 133.

Typically, the lamp housing 92 will include from one to ten lamps 130, although greater numbers are possible. The lamp 130 can be any of a wide range of suitable lamps, including single and multiple filament incandescent lamps, light-emitting diodes (LEDs), and laser-emitting illumination devices (optionally coupled with a collimator incorporated within the lamp housing). Typically a plurality of LED lamps is used. Suitable colors include, but are not limited to, white, red, yellow, blue, green, orange, amber, infra-red, and the like. For example, the lamp housing 92 can include six white lamps.

The lamps can be arranged in any suitable pattern. For example, in one embodiment, the lamps are arranged in cross pattern with four lamps located in a horizontal line and an additional lamp 130 is disposed above and below the linear array. Other patterns are possible. The lamps can also have the same or different light output. The lamps can optionally be removable or replaceable.

The lamp housing 92 optionally can include a reflector 136. A lamp 130 can be positioned within the housing so that it extends through a central opening in the reflector 136. The reflector 136 can be, for example, a parabolic reflector.

The lamp housing 92 typically further includes a transparent or translucent cover 138 that is placed over the aperture 137. The cover 138 also can be a lens that aids in focusing light from the lamp 130, or a diffuser to produce a diffuse light. The cover 138 can be permanently mounted to the lamp housing 92, or it can be removable. The cover 138 is typically sealingly attached to the lamp housing 92 to protect the lamp 130 from moisture, dust and the like. For example, the cover 138 can be "snap fit" to the lamp housing 92 (e.g., into a groove). The cover 138 also can be held in place by an elastomeric ring, or other suitable attachment mechanism. Referring to FIG. 6, the cover 138 also can be attached to the lamp housing 92 using an external elastomeric hood 141 that surrounds the aperture 137 and a portion of the lamp housing 92. The hood 141 holds the cover 138 in place.

An electrical circuit is provided between electrical contacts 120 of the lamp assembly 90 and the lamp 130. Referring to FIGS. 1, 3 and 5, the electrical contacts 120 can be positioned on collar 96 so that they make electrical connection with electrical contacts 110 of first or second mounting ports when the lamp assembly 90 is connected to a mounting port. The lamp 130 is electrically connected to electrical contacts 120 by electrical connector elements 56, such as posts, clips, wires, leads, or other electrically conductive materials. For example, a lamp 130 can have two leads, 130*a* and 130*b*. Lead 130*a* is electrically connected by a wire to one of the electrical contacts 120. Lead 130*b* is electrically connected by another wire to the other electrical contact 120. In another embodiment, a lamp socket 134 or circuit board 133 has leads or terminals that are connected to the electrical contacts 120 and lamp leads in a similar fashion.

The electrical connector elements are typically encased within the arms 94 of the lamp assembly 90. For example, the electrical connector elements can be routed from the electrical contacts 120 though the pivot to the lamp 130 in the lamp housing 92. In certain embodiments, a pivot mechanism (e.g., a pivot ring and pin or ball bearing race and ball bearing) can be part of the electrical circuit (i.e., they are electrically conductive). The electrical connector elements between the electrical contacts 120 and the lamp 130 also can be a first elongate lead 142 and a second elongate lead 144 extending from the lamp 130 through an arm 94 and to the rearward side of electrical contacts 120.

The portable light device 10 can optionally be connected to a charging device to recharge the battery. For example, a battery charger can be connected to the first or second mounting port to recharge the battery. Alternatively, a separate charging receptor can be position at any convenient point on the portable lighting device 10.

The portable lighting device 10 can incorporate a variety of useful control mechanisms for diversity and flexibility of function. The control mechanism can modulate power delivery from the battery to the lamp. This general function can be readily achieved using different configurations and sources for electrical connection and control.

The control mechanism can be an on-off switch 146. Depression of the switch 146 provides power to the lamp 130 or other electrical circuitry. A second depression of the switch 146 breaks the electrical connection. The switch 146 can be located on the lamp housing 92 or on the battery housing 12. For example, referring to FIG. 6, a switch 146 can be located on a side of the lamp housing 92. The switch 146 can optionally be covered by a flexible ceiling 148. The flexible ceiling 148 is typically manually depressible in a downward direction. This depression actuates the switch. To achieve this purpose, at least a central portion of the flexible ceiling 148 is resilient and is subject to downward deflection. In certain embodiments, all or a portion of the flexible ceiling 148 can be decorated with a rugose or ridged exterior surface to enhance manual engagability and flexibility of the ceiling 148. Alternatively, the exterior surface of the flexible ceiling 148 is smooth. Optionally, the flexible ceiling, or other portion of the switch, can glow to allow the switch to be readily located in the dark. In other embodiments, the switch 146 can also be located on the battery housing 12 of the flashlight 10.

The control mechanism can also be an on/off switch mechanism as described above supplemented or replaced by, or integrated with, a multi-function control device. The control device can include one or mote operational modes. The first operational mode can be, for example, a selectable control mechanism that functions as a on/off switch to selectably connect and disconnect power from the battery 52 to the lamp 130 (for example in the manner of the single function switch described above). A second operational mode can be, for example, a brightening or dimming mode, and the control device can include an analog control circuit, such as a conventional dimming circuit. Another operational mode can be, for example, a flashing mode, and the control device can include an analog control circuit, such as a conventional flasher circuit electrically connected to the lamp 130. Additional operational modes that may be controlled by the multiple function control device include, but are not limited to, an auto-off mode or a hyper-bright mode. In addition, an additional operational mode can optionally be a battery protection mode, which turns the lamp off if a switch is depressed for a certain period of time.

In certain embodiments, the control device includes a microprocessor control unit 154 that functions to control one or more operational modes of the lamp 130. The microprocessor control unit 154 can be located on a circuit board 133, integrated within a wall of the lamp housing 92, the battery housing 12, or it can be affixed to the lamp housing 92 or battery housing 12. The microprocessor control unit 154 is typically located within an interior space defined by the lamp assembly 90.

Typically, the microprocessor control unit 154 is incorporated in an electronic board or cassette 156 that is fitted for secure enclosure within the lamp housing 92 or battery housing 12. The electronic board or cassette 156 optionally can be removed for replacement and interchangement with different cassettes having different control functions. In certain embodiments, such a microprocessor control unit 154 can be fitted within a cavity defined by the flexible ceiling 148 of the lamp housing 92. In another embodiment, the microprocessor control unit 154 can be fitted within the lamp housing and is retained within the housing by one or more retaining elements 158 (e.g., an interlocking groove or ridge, peg, snap-fitting, etc.) connected to the lamp housing 92 that securely interlock or receive a mounting element 160 (e.g., a mated ridge, groove or peg-hole) integrated with the control unit 154 or cassette 156.

Figure 7:
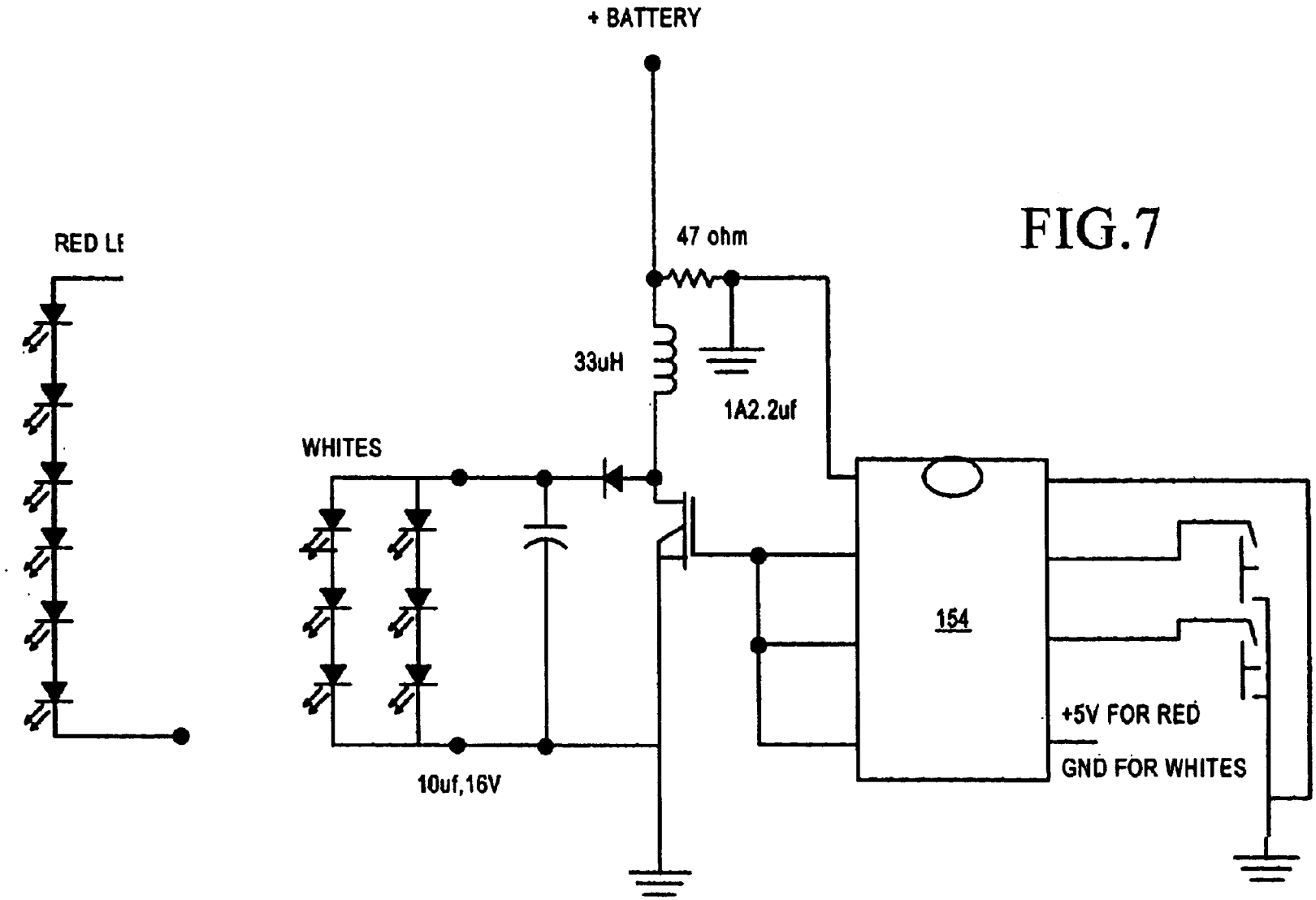
FIG. 7 depicts an embodiment of an electrical circuit including a microprocessor control unit.

The electrical connections of a circuit interconnecting the battery 52, lamp 130 and microprocessor control 154, and the design and circuitry of the microprocessor, can be routinely configured among different embodiments in accordance with general methods and materials known in the art. Referring to FIG. 7, an example of such a circuit is depicted. The circuit can include six LEDs, wired in series or in two parallel series. A microprocessor control unit 154 controls the operational mode of the lamp 130. Such a circuit can optionally provide constantly metered and regulated electrical power to the microprocessor control unit 154. The circuit can optionally include a power gauge and display to indicate the level of power remaining in the battery.

Actuation of the microprocessor control unit 154, as well as selection of different operating modes, frequencies and intensities of the lamp 130 controlled by the microprocessor control unit 154, can be implemented by one or more, manually, electrically or remotely actuated switching devices. Typically, a single microprocessor switch is used to actuate the microprocessor and select mode and other functional changes for the lamp. Depression of the switch selects a first mode of operation of the lamp. Continued depression of the switch for a pre-set time period, that determines a selection change by the microprocessor, may select a different intensity or frequency of lamp operation. The pre-set period for determining a mode or intensity or frequency change is typically between about 1–10 seconds, or between about 2–5 seconds, and or about 4 seconds. Alternatively, continued depression of the switch can select a second operational mode of the lamp, followed upon expiration of the set selection time period by a third operational mode, then a fourth mode, etc.

Through the application of conventional microcircuitry design, in conjunction with the teachings according to the present invention, the microprocessor control unit 154 can be designed to control a wide variety of selectable modes and functions of the portable lighting device 10. As noted above, exemplary modes include a one or more flashing modes; brightening modes; dimming modes; battery protection modes; and/or an auto-off modes. In one exemplary embodiment, selectable lamp operational modes controlled by the microprocessor are sequentially ordinated and selected by continuous depression of the microprocessor switch as follows: A first, on/dimming mode is activated by initial depression of the microprocessor switch while the microprocessor is in a powered, resting state. This powers the lamp at a maximal intensity. Continued depression of the switch, e.g., for a pre-set selection change delay period of about 2–5 seconds, determines selection of a lower intensity, followed by a third intensity level. Upon expiration of these three selection periods, the microprocessor determines selection of a second operational mode, in this example a flashing mode. In the first flashing mode selection period the lamp flashes rapidly (e.g., about 16 Hz). In second and third flashing mode selection periods the lamp flashing rate gets sequentially slower. Release of the switch, e.g., by termination of manual pressure on the switch, fixes the setting of the lamp mode and frequency or intensity at the last setting determined during the scroll-through sequence.

Another mode of operation can be an automatic shut-off or auto-off mode. This control function of the microprocessor activates the lamp for a short term set period, for example 1–3 minutes, after which the lamp 130 is automatically shut off. This allows the user to select a short period of lighting to shut the light off after the desired lighting period. Thus, for example, the user can set the portable lighting device 10 on a night stand in auto-off mode and then walk across the lit room to bed with only a brief period before the controller executes the auto-off end function. This mode also provides a safety feature that prevents exhaustion of battery power when the lamp is inadvertently activated, e.g., when the flashlight is stowed in a pack and the control mechanism impinges against a hard object. Whereas the lamp will automatically come on and stay on (e.g., continue flashing) in any other of the selected modes, if the light is stored in auto-off mode it will only activate the light for a preset, auto-off delay period, for example between about 1–3 minutes, before the controller automatically terminates power to the lamp 130. The auto-off mode typically represents the last mode in a series of function modes that can be selected. Also, a fast-flashing or strobe activation of the lamp mode can be set by the microprocessor to initiate as well as terminate the auto-off mode to warn users that a disruption of light omission will imminently occur. In addition, a battery protection mode can optionally turn the lamp off if a switch is continually activated from a predetermined period of time.

Several accessory pieces are optionally provided for use with the portable lighting device 10. Referring to FIGS. 3 and 8, a headlamp clip 170 is also optionally provided. The headlamp clip 170 typically includes a plurality of mounting tabs 172 that engage mounting receptacles 174. For example, referring to FIGS. 1 and 2, three mounting receptacles 174 are shown disposed on the battery housing 12. The mounting tabs 172 can optionally be disposed on a projecting portion 178 of the accessory clip 170. Greater and less numbers of mounting receptacles 174 and mounting tabs 172 are possible and within the scope of the invention. Referring to FIG. 3, the accessory clip 170 can also include a plurality of flanges 176 for mounting to a belt, elastic strap, or similar device. For example, accessory clip 170 can have three sets of flanges 176 for receiving a three point woven elastic headband.

Other accessory pieces can also be provided. For example, referring to FIG. 4, a belt clip 180 is shown mounted to an embodiment of the battery housing 12. The belt clip 180 can include a resilient flange 186 for insertion over a belt or similar article. The belt clip 180 can be attached to the battery housing 12 using mounting tabs 182 that insert into mounting apertures 174 on the battery housing 12.

Referring to FIG. 9, another embodiment of a belt clip 180 is depicted. Such a belt clip 180 can include a resilient flange 186 for insertion over a belt or similar article. The resilient flange can be pivotally connected to the body 187 of the belt clip 180. The belt clip 180 can be attached to the battery housing 12 using threaded screw that can be threadably attached, for example, to the threaded receptacle 72 of the second mounting port.

The portable lighting device 10 also can optionally include a bicycle clip for attachment of the portable lighting device to a bicycle (e.g., to the handlebars and/or a seat post). Referring to FIG. 10, the bicycle includes a body 202 and a compression fitting comprising a pair of arms 204. The arms 204 form a compressible connection mechanism, which can be tightened and loosened by tightening and loosening a screw inserted through apertures 206. Other mechanism for attaching the portable lighting device to a person, bicycle or other vehicle are possible.

While the invention has been described with reference to specific embodiments, the description is illustrative of the invention and is not to be construed as limiting the invention. Various modifications and applications may occur to those skilled in the art without departing from the true spirit and scope of the invention as defined by the appended claims.

What is claimed is:

1. A convertible lighting device comprising:

a battery housing having at least one side portion, a bottom portion and a top portion defining a battery compartment which receives at least one battery;

a first mounting port disposed on said battery housing, said first mounting port including first and second electrical contacts that are electrically connected to said at least one battery;

a second mounting port disposed on said battery housing, said second mounting port including third and fourth electrical contacts and electrically connected to said at least one battery;

a removable lamp assembly having a collar, arms connected to said collar, and a lamp housing pivotally mounted between said arms;

fifth and sixth electrical contacts fixed to said collar, said fifth and sixth electrical contacts electrically connected to at least one lamp disposed in said lamp assembly; and switching means electrically connected between said at least one battery and at least one lamp to modulate power delivery from said at least one battery to said at least one lamp;

wherein said lighting device is operated in a flashlight mode when said lamp assembly is connected to said first mounting port; and said lighting device is operated in a headlamp mode when said lamp assembly is connected to said second mounting port.

2. The convertible lighting device of claim 1, wherein said battery housing has three sides.

3. The convertible lighting device of claim 1, wherein said first mounting port is located at said top portion, and said second mounting port is located at said at least one side portion.

4. The convertible lighting device of claim 1, wherein said top portion is hingedly connected to said at least one side portion.

5. The convertible lighting device of claim 1, wherein said battery compartment holds three batteries.

6. The convertible flashlight of claim 1, further comprising a screw connected to said collar; and said first and second mounting ports further comprising threaded receptacles for receiving said screw.

7. The method of claim 1, wherein said first and second mounting ports each comprise orientation receptacles; and said collar comprises orientation tabs.

8. The method of claim 1, wherein said at least one lamp is a light emitting diode.

9. The convertible light device of claim 1, wherein said switching means is located in said lamp housing.

10. The convertible light device of claim 9, wherein said switching means further comprises a flexible ceiling.

11. The convertible light device of claim 10, wherein said flexible ceiling comprises an ovate or circular diaphragm integrally formed and centrally disposed in said lamp housing.

12. The convertible light device of claim 11, wherein said flexible ceiling has an external surface decorated by concentric grooves and ridges to enhance manual engagability and flexibility of said flexible ceiling.

13. The convertible light device of claim 1, further comprising a reflector disposed in said lamp housing.

14. The convertible light device of claim 1, wherein said switching means comprises a multi-function control device having selectable control means to connect and disconnect power from said at least one battery to said at least one lamp and to select between a plurality of operational modes of said at least one lamp.

15. The convertible light device of claim 14, wherein said selectable control means includes a manual switch to control an on-off mode of said at least one lamp and an analog control circuit to control a second operational mode of said at least one lamp.

16. The convertible light device of claim 15, wherein said second operational mode of said at least one lamp is a flashing mode, and wherein said analog control circuit comprises a flasher circuit electrically connected to said at least one lamp comprising a switching transistor serially connected between said at least one battery and said at least one lamp and a switching transistor control network including a control transistor and a resistor-capacitor network functionally interconnected to effect a controlled flashing operational mode of said at least one lamp.

17. The convertible light device of claim 14, wherein said selectable control means includes a microprocessor functional to control at least one operational mode of said at least one lamp.

18. The convertible light device of claim 17, wherein said at least one operational mode is a flashing mode, a brightening mode, a dimming mode, a battery protection mode, or an auto-off mode.

19. The convertible light device of claim 18, wherein said microprocessor further controls a cycle rate or intensity of said at least one lamp within a selected operational mode.

20. The convertible light device of claim 19, wherein said microprocessor controls a brightening or dimming mode having at least two selectable lamp intensity options, a flashing mode having at least two selectable lamp flashing rate options, and an auto-off mode functional to automatically terminate power to said at least one lamp after a predetermined time of operation.

* * * * *